US008136169B2

(12) United States Patent
Taylor

(10) Patent No.: US 8,136,169 B2
(45) Date of Patent: Mar. 20, 2012

(54) HEADWEAR COOLING SYSTEM AND ASSOCIATED METHOD

(76) Inventor: Lori N. Taylor, Washington, DC (US)

( * ) Notice: Subject to any disclaimer, the term of this patent is extended or adjusted under 35 U.S.C. 154(b) by 871 days.

(21) Appl. No.: 12/220,097

(22) Filed: Jul. 22, 2008

(65) Prior Publication Data

US 2010/0017941 A1 Jan. 28, 2010

(51) Int. Cl.
*A42C 5/04* (2006.01)

(52) U.S. Cl. ..... 2/171.3

(58) Field of Classification Search ..... 2/171.3, 2/209.13

See application file for complete search history.

(56) References Cited

U.S. PATENT DOCUMENTS

| | | | | |
|---|---|---|---|---|
| 4,893,356 | A * | 1/1990 | Waters | 2/171.3 |
| 6,122,773 | A * | 9/2000 | Katz | 2/171.3 |
| 6,760,925 | B1 * | 7/2004 | Maxwell | 2/171.3 |
| 2005/0132468 | A1 * | 6/2005 | Lundgren | 2/171.3 |

* cited by examiner

*Primary Examiner* — Katherine Moran

(57) ABSTRACT

A combined headwear and cooling system preferably includes a headwear, a mechanism for introducing and circulating external ambient air, and a mechanism for selectively discharging the external ambient air from the inner surface area in such a manner that a discharge rate of the external ambient air is regulated along a plurality of separate target zones defined along the curvilinear region. The present invention allows the user to control the air flow along different portions of the curvilinear region and thereby focus the cooling process on regions that are prone to overheat more quickly than others.

16 Claims, 4 Drawing Sheets

HEADWEAR COOLING SYSTEM AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to headwear and, more particularly, to a headwear cooling system for circulating air along a user head.

2. Prior Art

Just about everyone owns some form of headwear. Persons spending a considerable amount of time in the out-of-doors, such as workmen, athletes, sports fans, fishermen, and the like, frequently wear headwear to protect themselves from the heat or cold of the surrounding atmosphere. There is an ever increasing demand today for providing the comfort of cooling of the wearer of the head gear during hot weather conditions. As such, many air conditioned hats, helmets, or the like have been provided for achieving these end results.

One prior art example shows a fan that is mounted in part of a hat or other headwear wherein two spaced apart disc-like members, each provided with openings through which air may be directed, have a fan impeller rotatably mounted therebetween. The construction of such a device is complicated as it includes ears or tabs for detachably securing the fan to the selected head gear. Another prior art example discloses a battery-driven fan for attachment to the brim or peak of a hat or cap, and has an adjustable visor for directing the air-flow onto the forehead or face of the user. That arrangement necessitates that the visor is mounted before the user's eyes and prevents a clear view forward. It is generally distracting and objectionable particularly if the user is participating in a sport, e.g. a ball game, at the time. Furthermore, the fan unit is retained on the brim of a hat by means of a resilient retaining ring which does not afford reliable permanent or semi-permanent mounting of the fan unit within the brim of the hat.

U.S. Pat. No. 5,557,807 to Hujar discloses an article of headwear for covering the head, such as a hat, cap, or helmet, which includes coolant means for cooling the head of the wearer, and more particularly, cooling means which provide a prolonged cooling effect. The coolant means is contained in one or more pouches comprised of two layers of different materials, the first or outer material being a thin material having good thermal transmissive properties and preferably also having some water resistant properties, and the second or inner material provided interior of the first material and having thermal insulative properties. These layers, used in combination, have an effect of absorbing heat from the head of the wearer without at the same time absorbing excessive heat from the environment, and thus provide a sustained cooling effect. A heat releasing means can be substituted in place of the coolant means when it is desired to warm the head of the wearer. Unfortunately, this prior art example does not provide a user with a continuous cooling breeze to the head and face.

U.S. Pat. No. 5,327,585 to Karlan discloses a elongated, semi-flat tubular body constructed of flexible fluid impervious material, and the tubular body is divided into separate longitudinally spaced compartments along longitudinally spaced flexible transverse zones of the body. The compartments are filled with a fluid eutectic solution and the body may be folded along the transverse zones for relative angular displacement of the adjacent compartments. The elongated, semi-flat tubular body may be removably supported within the channel defined by the sweat band of a hat or cap and may be used to absorb heat from the adjacent head areas of the wearer of the hat or to provide heat to those adjacent head areas. Unfortunately, this prior art example does not provide a user with a continuous cooling breeze to the head and face.

Accordingly, the present invention is disclosed in order to overcome the above noted shortcomings. The headwear cooling system is convenient and easy to use, lightweight yet durable in design, and designed for circulating air along a user head. The system is simple to use, inexpensive, and designed for many years of repeated use.

BRIEF SUMMARY OF THE INVENTION

In view of the foregoing background, it is therefore an object of the present invention to provide a system for circulating air along a user head. These and other objects, features, and advantages of the invention are provided by a headwear cooling system of the present invention.

A combined headwear and cooling system preferably includes a headwear that has a curvilinear region effectively adapted to be situated about the user head. The system may further include a mechanism for introducing and circulating external ambient air throughout an entire inner surface area of the curvilinear region. Such an external ambient air introducing and circulating mechanism may preferably include a protective casing positioned external of a peak of the headwear, a user interface displayed on an exterior surface of a posterior of the curvilinear region and accessible while the headwear is seated on the user head, a power source electrically coupled to the user interface, and a motor housed within the casing. Such a motor is electrically coupled to the power source and the user interface respectively. The mechanism may further include an internal cavity extending inwardly from a circumference of the curvilinear region and oriented along the entire inner surface area thereof, and a rotary fan situated subjacent to the casing and further being disposed within the internal cavity for circulating the external ambient air therein. Such a rotary fan adjoins the peak of the headwear.

The system may further include a mechanism for selectively discharging the external ambient air from the inner surface area in such a manner that a discharge rate of the external ambient air is conveniently regulated along a plurality of separate target zones defined along the curvilinear region. Such an external ambient air selectively discharging mechanism preferably includes a plurality of outlet port groups passing through an innermost wall of the internal cavity. Each of such outlet port groups is aligned along a corresponding one of the target zones, and each of the target zones may be defined along vertically spaced hemispherical paths spanning along a unique section of the innermost wall of the internal cavity respectively.

Each of such hemispherical paths preferably has a unique circumferential length respectively. A bottom-most one of the target zones may have a maximum diameter spanning between a corresponding one of the hemispherical paths respectively, and a top-most one of the target zones may have a minimum diameter spanning between a corresponding one of the hemispherical paths respectively. The external ambient air introducing and circulating mechanism and the selectively discharging mechanism are preferably independently and simultaneously adapted between alternate operating modes.

The external ambient air selectively discharging mechanism may further include a plurality of curvilinear tabs adjustably positioned along the hemispherical paths respectively. Such curvilinear tabs may be slidably abutted against corresponding ones of the outlet port groups such that the external ambient air is preferably prohibited from entering corresponding ones of the target zones respectively. The external ambient air discharge rate may be advantageously maximized when a maximum number of the outlet port groups are blocked by the curvilinear tabs respectively, and the external ambient air discharge rate may be minimized when a minimum number of the outlet port groups are blocked by the curvilinear tabs respectively.

A preferable method for circulating air along a user head may include the steps of: providing a headwear that has a curvilinear region; situating the curvilinear region about the user head; introducing and circulating external ambient air throughout an entire inner surface area of the curvilinear region; and selectively discharging the external ambient air from the inner surface area in such a manner that a discharge rate of the external ambient air is regulated along a plurality of separate target zones defined along the curvilinear region; and independently and simultaneously adapting the external ambient air introducing and circulating mechanism and the selectively discharging mechanism between alternate operating modes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
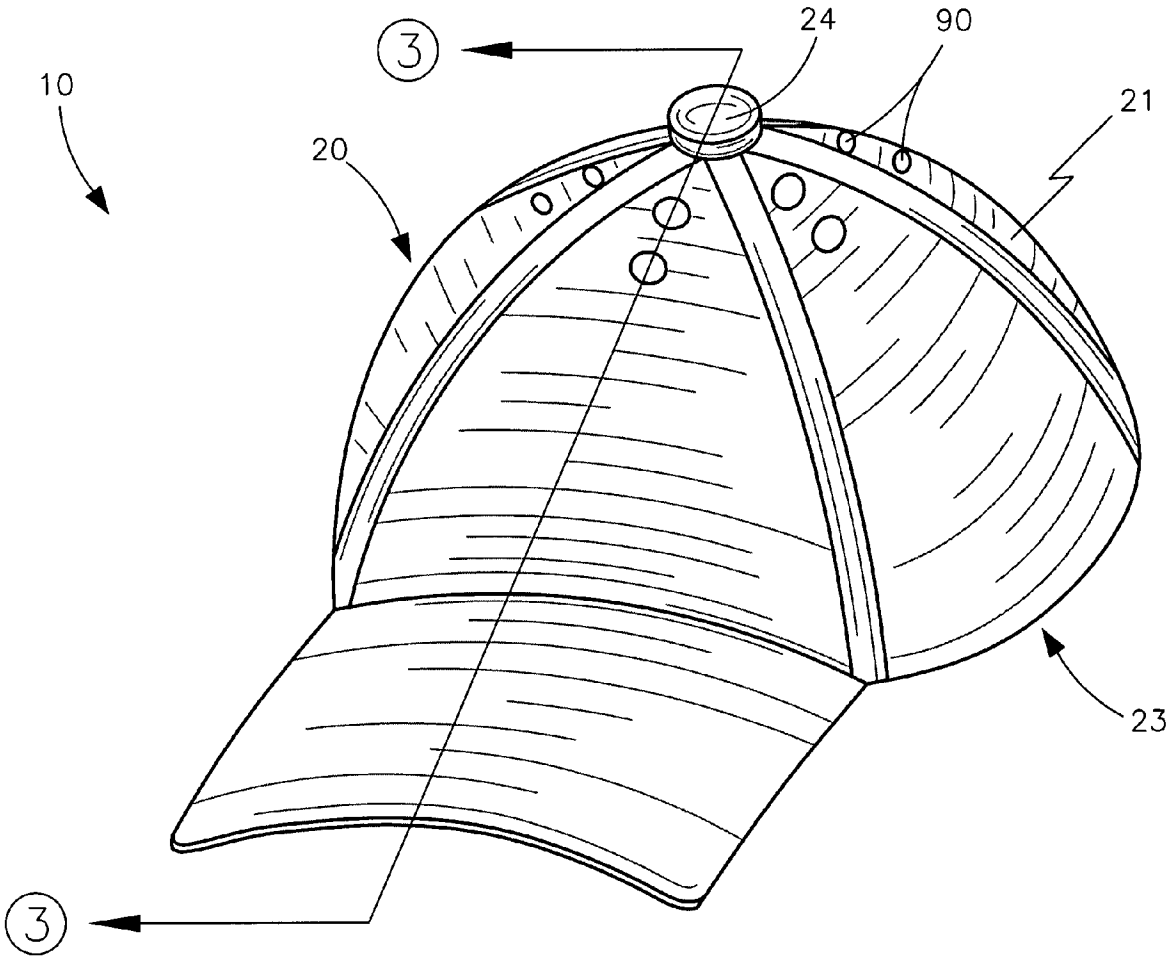
FIG. 1 is a perspective view of a combined headwear and cooling system, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-4 by the reference numeral 10 and is intended to provide a combined headwear and cooling system. It should be understood that the system 10 may be used to provide a cooling system for many different types of headwear and should not be limited to use with only those types of headwear mentioned herein.

Referring initially to FIGS. 1 through 4, a combined headwear and cooling system 10 preferably includes a headwear 20 that has a curvilinear region 21 adapted to be situated about the user head. The system 10 may further include a mechanism 22 for introducing and circulating external ambient air 11 throughout an entire inner surface area 23 of the curvilinear region 21. Such an external ambient air introducing and circulating mechanism 22 may preferably include a protective casing 24 positioned external of a peak of the headwear 20, a user interface 25 displayed on an exterior surface of a posterior side of the curvilinear region 21 and being accessible while the headwear 20 is seated on the user head, a power source 26 electrically coupled to the user interface 25, and a motor 27 housed within the casing 24.

Such a motor 27 is electrically coupled to the power source 26 and the user interface 25 respectively. The mechanism 22 may further include an internal cavity 28 extending inwardly from a circumference of the curvilinear region 21 and oriented along the entire inner surface 23 area thereof. A rotary fan 29 is situated subjacent to the casing 24 and disposed within the internal cavity 28 for circulating the external ambient air 11 therein. Such a rotary fan 29 adjoins the peak of the headwear 20. The internal cavity 28 provides the unpredictable and unexpected result of ensuring that a user's head may advantageously be cooled by the system 10 while the user's hair does not inadvertently engage the rotary fan 29 and thereby accidentally halt smooth cooling operations of the system 10.

Figure 2:
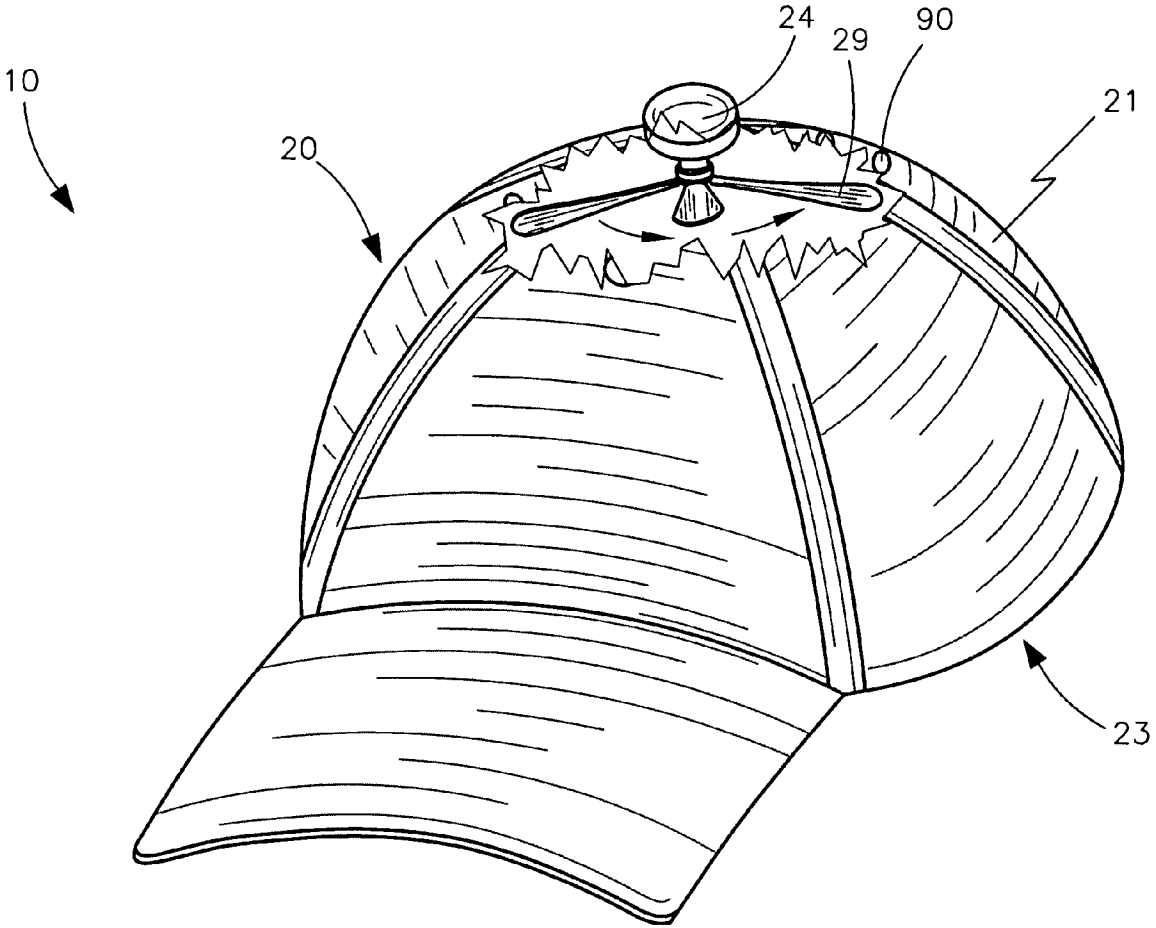
FIG. 2 is a perspective view of the present invention, with a partially broken view showing the rotary fan of the ambient air introducing and circulating mechanism.
Figure 3:
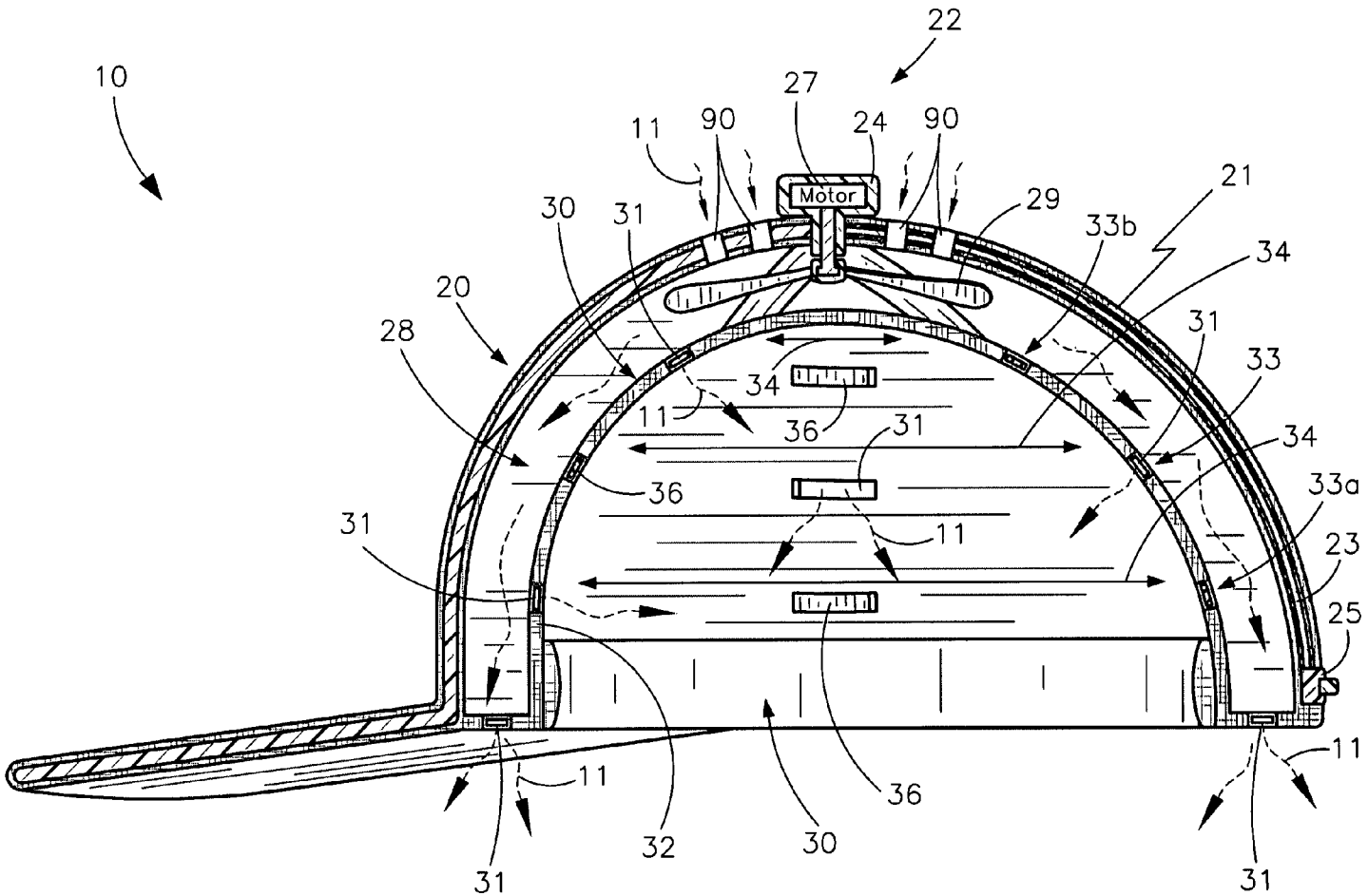
FIG. 3 is a cross sectional view of the combined headwear and cooling system, taken along line 3-3, as seen in FIG. 1.
Figure 4:
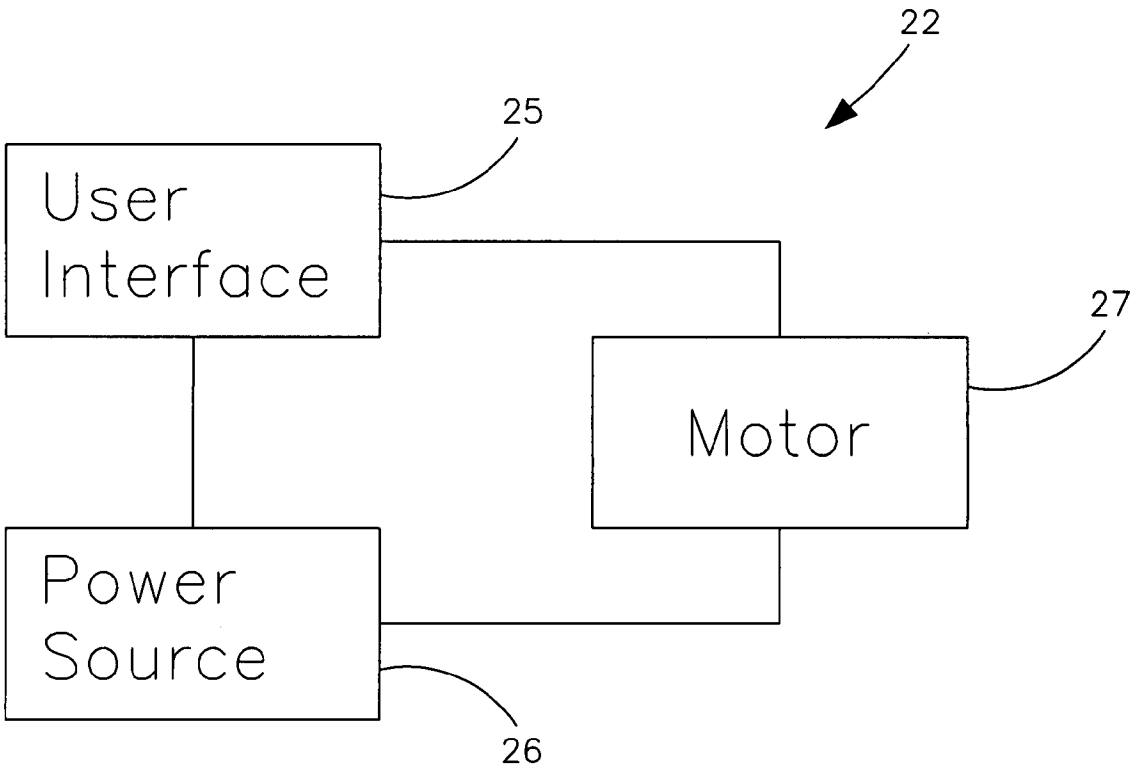
FIG. 4 is a high-level schematic block diagram of the ambient air introducing and circulating mechanism.

Referring to FIGS. 1 through 3, the system 10 may further include a mechanism 30 for selectively discharging the external ambient air 11 from the inner surface area 23 in such a manner that a discharge rate of the external ambient air 11 is regulated along a plurality of separate target zones defined along the curvilinear region 21. It is understood that the separate target zones are located are various areas through curvilinear region 21 such as near a user's forehead and a rear side of the user head, for example. Such an external ambient air selectively discharging mechanism 30 preferably includes a plurality of outlet port groups 31 passing through an innermost wall 32 of the internal cavity 28. Each of such outlet port groups 31 is aligned along a corresponding one of the target zones 33, and each of the target zones 33 may be defined along vertically spaced hemispherical paths 34 spanning along a unique section of the innermost wall 32 of the internal cavity 28 respectively.

Each of such hemispherical paths 34 preferably may have a unique circumferential length 35 respectively extending along an inner diameter of the curvilinear region 21. A bottom-most one 33A of the target zones 33 may have a maximum diameter spanning between a corresponding one of the hemispherical paths 34 respectively, and a top-most one 33B of the target zones 33 may have a minimum diameter spanning between a corresponding one of the hemispherical paths 34 respectively. The external ambient air introducing and circulating mechanism 22 and the selectively discharging mechanism 30 are preferably independently and simultaneously adapted between alternate operating modes. Such an independent and simultaneous adaption permits the user to advantageously direct the air along various hemispherical paths 34 while the fan 29 is operating.

The external ambient air selectively discharging mechanism 30 may further include a plurality of curvilinear tabs 36 adjustably positioned along the hemispherical paths 34 respectively. It is understood that the tabs 36 travel along the hemispherical paths 34 and are partially hidden in FIG. 3 but one skilled in the art understands that such tabs 36 are juxtaposed along the paths defined by the arrows in FIG. 3, for example. Such curvilinear tabs 36 may be slidably abutted against corresponding ones of the outlet port groups 31 such that the external ambient air 11 is preferably prohibited from entering corresponding ones of the target zones 33 respectively.

The external ambient air discharge rate may be maximized when a maximum number of the outlet port groups 31 are blocked by the curvilinear tabs 36 respectively, and the external ambient air discharge rate may be minimized when a minimum number of the outlet port groups 31 are blocked by the curvilinear tabs 36 respectively. The mechanism 30 further may include a plurality of vents 90 located at a top region of the curvilinear region 21, which is essential for bringing the external ambient air 11 through the external ambient air selectively discharging mechanism 30 via the external ambient air introducing and circulating mechanism 22 while the curvilinear region 21 is directly seated on the user's head.

In use, a preferable method for circulating air along a user head may include the steps of: providing a headwear 20 that has a curvilinear region 21; situating the curvilinear region 21 about the user head; introducing and circulating external ambient air 11 throughout an entire inner surface area 23 of the curvilinear region 21; and selectively discharging the external ambient air 11 from the inner surface area 23 in such a manner that a discharge rate of the external ambient air 11 is regulated along a plurality of separate target zones 33 defined along the curvilinear region 21; and independently and simultaneously adapting the external ambient air introducing and circulating mechanism 22 and the selectively discharging mechanism 30 between alternate operating modes.

In one embodiment, the system 10 may include an external ambient air introducing and circulating mechanism 22 that is directly attached, without the use of intervening elements, to an inner surface area 23 of a curvilinear region 21 of a headwear 20. A plurality of curvilinear tabs 36 may be directly attached, without the use of intervening elements, around the rim of the headwear 20. Such headwear 20 is preferably fabricated of durable cloth material such as cotton or wool, and is substantially sized and shaped like a standard baseball cap, for example. The headwear 20 may also include a front bill extension.

A plurality of outlet port groups 31 may have a mesh screen that effectively serves to allow the air from the external ambient air introducing and circulating mechanism 22 to blow directly onto the top of the user head. The plurality of curvilinear tabs 36 preferably lines the rim of the headwear 20 for providing a comfortable fit. Of course, the headwear 20 could be offered in a wide variety of colors and designs and could incorporate embroidered sports team logos, funny and whimsical sayings, or other various symbols relating to interests, as is obvious to a person of ordinary skill in the art. A user interface 25 may be conveniently positioned on the outer surface of the headwear 20 in an easily accessed location, such as at the rear side of the curvilinear region 21.

In use, the system 10 is easy and straightforward to operate. The user simply dons the headwear 20 per usual when spending the day outside for effectively and advantageously keeping the sun out of their eyes. Thus, as the day progresses and the user becomes heated, they can quickly and easily apply power via the user interface 25 located on the side of the headwear 20. This activates the external ambient air introducing and circulating mechanism 22, thereby causing the mechanism 22 to circulate the air within the headwear 20. Of course, the system 10 can easily be adapted to include hard hats worn by construction workers and protective helmets donned by athletes, as is obvious to a person of ordinary skill in the art.

The present invention, as claimed, provides the unexpected and unpredictable benefit of a system that is convenient and easy to use, is durable yet lightweight in design, is versatile in its applications, and provides users with sun protection for their head and face, with the added option of a continuous cooling breeze to these areas as the day gets hot and sticky. As fashionable and functional headwear 20, the present invention 10 appeals to men, women and children alike. The system 10 is not only simple to use, but is also comfortable to wear. As a hands-free cooling means 22, the headwear cooling system advantageously allows the outdoor enthusiast to continue to enjoy watching sports, playing sports, running, gardening, camping, hunting, fishing, and vacationing.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined headwear and cooling system for circulating air along a user head, said combined headwear and cooling system comprising:

a headwear having a curvilinear region adapted to be situated about the user head;

means for introducing and circulating external ambient air throughout an entire inner surface area of said curvilinear region; and means for selectively discharging the external ambient air from said inner surface area in such a manner that a discharge rate of the external ambient air is regulated along a plurality of separate target zones defined along said curvilinear region;

wherein said external ambient air introducing and circulating means comprises a protective casing positioned external of a peak of said headwear;

a user interface displayed on an exterior surface of said curvilinear region and being accessible while said headwear is seated on the user head;

a motor housed within said casing, said motor being electrically coupled to said power source and said user interface respectively;

an internal cavity extending inwardly from a circumference of said curvilinear region and being oriented along the entire inner surface area thereof; and a rotary fan situated subjacent to said casing and further being disposed within said internal cavity for circulating the external ambient air therein;

wherein said external ambient air selectively discharging means comprises a plurality of outlet port groups passing through an innermost wall of said internal cavity, each of said outlet port groups being aligned along a corresponding one of said target zones;

wherein each of said target zones are defined along vertically spaced hemispherical paths spanning along a unique section of said innermost wall of said internal cavity respectively, each of said hemispherical paths having a unique circumferential length respectively;

wherein said external ambient air selectively discharging means further comprises a plurality of curvilinear tabs adjustably positioned along said hemispherical paths respectively, said curvilinear tabs being slidably abutted against corresponding ones of said outlet port groups such that the external ambient air is prohibited from entering corresponding ones of said target zones respectively.

2. The combined headwear and cooling system of claim 1, wherein said rotary fan adjoins said peak of said headwear.

3. The combined headwear and cooling system of claim 1, wherein a bottom-most one of said target zones has a maximum diameter spanning between a corresponding one of said hemispherical paths respectively.

4. The combined headwear and cooling system of claim 1, wherein a top-most one of said target zones has a minimum diameter spanning between a corresponding one of said hemispherical paths respectively.

5. The combined headwear and cooling system of claim 1, wherein the external ambient air discharge rate is maximized when a maximum number of said outlet port groups are blocked by said curvilinear tabs respectively.

6. The combined headwear and cooling system of claim 1, wherein the external ambient air discharge rate is minimized when a minimum number of said outlet port groups are blocked by said curvilinear tabs respectively.

7. A combined headwear and cooling system for circulating air along a user head, said combined headwear and cooling system comprising:

a headwear having a curvilinear region adapted to be situated about the user head;

means for introducing and circulating external ambient air throughout an entire inner surface area of said curvilinear region; and means for selectively discharging the external ambient air from said inner surface area in such a manner that a discharge rate of the external ambient air is regulated along a plurality of separate target zones defined along said curvilinear region;

wherein said external ambient air introducing and circulating means and said selectively discharging means are independently and simultaneously adapted between alternate operating modes.

8. The combined headwear and cooling system of claim 7, wherein said external ambient air introducing and circulating means comprises:

a protective casing positioned external of a peak of said headwear;

a user interface displayed on an exterior surface of said curvilinear region and being accessible while said headwear is seated on the user head;

a motor housed within said casing, said motor being electrically coupled to said power source and said user interface respectively;

an internal cavity extending inwardly from a circumference of said curvilinear region and being oriented along the entire inner surface area thereof; and a rotary fan situated subjacent to said casing and further being disposed within said internal cavity for circulating the external ambient air therein.

9. The combined headwear and cooling system of claim 8, wherein said rotary fan adjoins said peak of said headwear.

10. The combined headwear and cooling system of claim 8, wherein said external ambient air selectively discharging means comprises:

a plurality of outlet port groups passing through an innermost wall of said internal cavity, each of said outlet port groups being aligned along a corresponding one of said target zones;

wherein each of said target zones are defined along vertically spaced hemispherical paths spanning along a unique section of said innermost wall of said internal cavity respectively, each of said hemispherical paths having a unique circumferential length respectively.

11. The combined headwear and cooling system of claim 10, wherein a bottom-most one of said target zones has a maximum diameter spanning between a corresponding one of said hemispherical paths respectively.

12. The combined headwear and cooling system of claim 10, wherein a top-most one of said target zones has a minimum diameter spanning between a corresponding one of said hemispherical paths respectively.

13. The combined headwear and cooling system of claim 10, wherein said external ambient air selectively discharging means further comprises:

a plurality of curvilinear tabs adjustably positioned along said hemispherical paths respectively, said curvilinear tabs being slidably abutted against corresponding ones of said outlet port groups such that the external ambient air is prohibited from entering corresponding ones of said target zones respectively.

14. The combined headwear and cooling system of claim 13, wherein the external ambient air discharge rate is maximized when a maximum number of said outlet port groups are blocked by said curvilinear tabs respectively.

15. The combined headwear and cooling system of claim 13, wherein the external ambient air discharge rate is minimized when a minimum number of said outlet port groups are blocked by said curvilinear tabs respectively.

16. A method for circulating air along a user head, said method comprising the steps of:

a. providing a headwear having a curvilinear region;

b. situating said curvilinear region about the user head;

c. introducing and circulating external ambient air throughout an entire inner surface area of said curvilinear region; and d. selectively discharging the external ambient air from said inner surface area in such a manner that a discharge rate of the external ambient air is regulated along a plurality of separate target zones defined along said curvilinear region; and e. independently and simultaneously adapting said external ambient air introducing and circulating means and said selectively discharging means between alternate operating modes.

* * * * *